US009371713B2

(12) United States Patent
Kleppa

(10) Patent No.: US 9,371,713 B2
(45) Date of Patent: Jun. 21, 2016

(54) PLUG SENSOR

(75) Inventor: Erling Kleppa, Jørpeland (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 0 days.

(21) Appl. No.: 13/519,143

(22) PCT Filed: May 16, 2012

(86) PCT No.: PCT/EP2012/059143

§ 371 (c)(1),
(2), (4) Date: Sep. 28, 2012

(87) PCT Pub. No.: WO2013/056858

PCT Pub. Date: Apr. 25, 2013

(65) Prior Publication Data

US 2013/0027215 A1 Jan. 31, 2013

(30) Foreign Application Priority Data

Oct. 21, 2011 (NO) ..... 20111436

(51) Int. Cl.
*G01V 3/00* (2006.01)
*E21B 34/02* (2006.01)
*E21B 33/068* (2006.01)

(52) U.S. Cl.
CPC ..... *E21B 34/02* (2013.01); *E21B 33/068* (2013.01)

(58) Field of Classification Search
CPC ..... E21B 33/068; E21B 34/02
USPC ..... 340/850–853.2; 73/708; 257/99–100
See application file for complete search history.

(56) References Cited

U.S. PATENT DOCUMENTS 4,011,650 A * 3/1977 Granada ..... 29/421.1
4,116,044 A * 9/1978 Garrett ..... 73/40.5 R
4,617,607 A * 10/1986 Park et al. ..... 361/283.4
5,172,112 A * 12/1992 Jennings ..... 340/850

(Continued)

FOREIGN PATENT DOCUMENTS

CA 2441242 3/2005
GB 2377239 1/2003

(Continued)

OTHER PUBLICATIONS

Norwegian Search Report (submitted inter alia as statement of relevance for NO20081110).

*Primary Examiner* — Hai Phan
*Assistant Examiner* — Royit Yu
(74) *Attorney, Agent, or Firm* — Birch, Stewart, Kolasch & Birch, LLP

(57) ABSTRACT

The present invention relates to an apparatus for monitoring physical parameters in an oil and/or gas well, the apparatus being connectable to a wellhead of the oil and/or gas well. The apparatus comprises a flange assembly configured with a through bore and an end termination, in which through bore a sensor and associated electronics are arranged. The sensor, including a first electronic circuitry, is connected to a second electronic circuitry via transmission devices that are passed through a pressure-tight element arranged in the through bore. The invention also relates to a wellhead for use with an oil and/or gas well with a plurality of casings defining a plurality of annili. The wellhead is configured with a plurality of through-holes, each leading into a respective annulus of the well, and each through-hole is connected to an apparatus as mentioned above.

8 Claims, 4 Drawing Sheets

(56) References Cited

U.S. PATENT DOCUMENTS

| | | | | |
|---|---|---|---|---|
| 5,677,631 | A | 10/1997 | Reittinger | |
| 6,484,585 | B1 | 11/2002 | Sittler | |
| 7,000,478 | B1 * | 2/2006 | Zwollo et al. | 73/708 |
| 7,025,143 | B2 * | 4/2006 | Masak | 166/311 |
| 2002/0195247 | A1 * | 12/2002 | Ciglenec et al. | 166/250.11 |
| 2004/0089074 | A1 | 5/2004 | Avisse | |
| 2004/0238838 | A1 * | 12/2004 | Fujisawa et al. | 257/100 |
| 2007/0032957 | A1 | 2/2007 | Popilian | |
| 2009/0024327 | A1 * | 1/2009 | Berard et al. | 702/12 |
| 2009/0107246 | A1 | 4/2009 | Galinsky | |
| 2010/0200224 | A1 * | 8/2010 | Toguem Nguete et al. | 166/250.15 |
| 2011/0114333 | A1 * | 5/2011 | Fenton | 166/373 |
| 2011/0114387 | A1 * | 5/2011 | Belcher et al. | 175/57 |

FOREIGN PATENT DOCUMENTS

| | | |
|---|---|---|
| GB | 2377240 | 1/2003 |
| NO | 20081110 | 9/2009 |
| WO | 91/15740 | 10/1991 |
| WO | 2011/020668 | 2/2011 |

* cited by examiner

PLUG SENSOR

TECHNICAL FIELD

The present invention relates to an apparatus for monitoring an oil and/or gas well. More specifically, the present invention relates to an apparatus for monitoring physical parameters in an oil and/or gas well, the apparatus being connectable to a wellhead of the oil and/or gas well, the apparatus comprising a flange assembly configured with a through bore and an end termination, in which through bore a sensor and associated electronics are arranged, and wherein the sensor is connected to the associated electronics.

BACKGROUND

During well completion of a fully drilled oil and/or gas well, a number of casings of different lengths and diameters will be cemented to the ground formation. Between the casings, which are disposed coaxially with each other, a so-called annulus will be formed. To prevent a leakage in the oil and/or gas well, a plurality of packer elements will suitably be arranged between the casings. The casings will be suitably suspended from a wellhead structure, where the wellhead structure is arranged at the top of the oil and/or gas well. During operation of the oil and/or gas well, the wellhead structure will conduct the well stream therethrough for further processing of the well stream. The wellhead structure will also be a safety mechanism against the well stream flowing uncontrolled to the surface.

A wellhead structure of this kind is subjected to large loads and stresses from the surrounding environment. Although these structures and installations are designed to be maintenance-free for a number of years, they must be inspected constantly for safety and financial reasons.

It is both desirable and necessary to carry out an inspection of such offshore installations, for example, various equipment, pipelines, wellheads etc., not only during production, but also during drilling, installation and maintenance and repair work, this inspection taking placed in the form of automated operations. This means that quite different demands are made on the equipment and monitoring, inspection and communication systems that are used offshore than what is normal for installations onshore.

In addition to the above, it will be extremely important to know how an oil and/or gas well is behaving, or what is happening in the oil and/or gas well, and this will be the case throughout the entire lifetime of the well, i.e., from when the actual drilling of the well starts until the well is finally shut down. This is done by monitoring a number of different parameters in the well, which parameters may for example be contamination, leaks, well pressure, the production itself, sand/erosion in the well, wellhead temperature, the state or condition of various equipment (for example, the position of a valve), corrosion etc.

In connection with, for example, production of oil and/or gas wells, it will be extremely important from a safety, reliability and cost aspect to prevent a so-called pressure leak from the well through the different annuli in the casings, and out to the surroundings. If an undesirable pressure leak of this kind nevertheless occurs, various safety systems are intended to be able to close the well even under pressure, so that well fluid which has flowed into the different annuli of the well can circulate out in a controlled manner.

By constantly or repeatingly carrying out measurements of, for example, the pressure in the well, where this can be done at a number of different points in the well, it will be possible to have at an earlier point in time an indication that a pressure increase is about to occur in the well, that a pressure leak in the well will or has already occurred, whereby various actions can be taken to ensure that the consequences of such a pressure build-up will be minimal or to prevent them altogether.

Various solutions have therefore been developed to monitor and/or control pressure in an oil or gas well, Reference can be made, for example, to U.S. Pat. No. 5,172,112, in which there is known that a pressure-measuring device measures pressure in a subsea pipe. The device includes a stationary unit mounted to the exterior of the subsea pipe and a movable unit that is lowered into position next to the stationary unit whenever the pressure is to be monitored or measured. The stationary unit, which is a strain gauge, will monitor the pressure in the pipe by measuring the "strain" in the pipe. The measurements will subsequently be transmitted from the stationary unit in the form of suitable signals, whereby the movable unit will then convert these signals to give a picture of the pressure that is within the subsea pipe.

A solution is known from GB 2 286 682 where an inductive pressure transducer is used to measure the pressure within a pipe. This is accomplished by passing an alternating current within an inductor coil to generate a magnetic field. The magnetic field passes through a gap formed between the pipe and the inductor coil, and then into the pipe. The fluid flowing in the pipe will, owing to its pressure, induce stress in the pipe, which stress will cause variations in the electromagnetic properties of the material from which the pipe is made, which variations can be sensed by the magnetic field that is formed. The sensed variations can then be converted to give a pressure measurement.

Another system for detecting a leakage in an oil and/or gas well is described in U.S. Pat. No. 4,116,044, where the system comprises a plurality of pressure-sensitive transducers that are arranged in a through hole in a wellhead. The pressure-sensitive transducers will be so arranged that they can detect a leakage in a plurality of annuli in the well. The transducers are connected through wires to a junction box which will be capable of carrying signals to a processing location. During replacement of the transducers, the well will have to be shut down as the replacement operation will involve the well being "opened".

It is an object of the present invention to provide an improved apparatus for monitoring physical parameters in an oil and/or gas well, for instance with regard to safety, including fire safety, reliability and/or costs.

SUMMARY

The invention has been defined by the claims.

The apparatus disclosed herein may be used in a monitoring system which measures and monitors different parameters in an oil and/or gas well, for example, pressure and/or temperature, the monitoring system being designed so as to be capable of monitoring a number of different zones or areas in an oil and/or gas well. The purpose of the monitoring may be, through the measurements made, to see at an early stage that a pressure leak in the well is in the process of occurring, or already has occurred, thereby allowing various actions to be taken to prevent or even to limit the damage caused by the pressure leak. The apparatus can in a typical use be connected to a wellhead in the oil and/or gas well. However, it should be understood that the apparatus for monitoring physical parameters may also be used in other connections.

The disclosed apparatus comprises a flange assembly that is configured with a through bore and an end termination, which will seal or close an end of the apparatus. A sensor and associated electronics are arranged in the through bore. The sensor includes a first electronic circuitry. The sensor is connected to a second electronic circuitry via transmission devices, for example in the form of wires or the like, which are passed through a pressure-tight element arranged in the through bore. The pressure-tight element is arranged in the through bore in such a way that it separates two longitudinal portions of the through bore.

The pressure-tight element has, i.a., the effect of preventing a fluid leakage from occurring over the pressure-tight element. As a result, the apparatus will be provided with a double barrier arrangement for the passage leading into an annulus of the well head. This arrangement also provides a fire safe barrier between various parts of the apparatus, in particular between the sensor, including the first electronic circuitry, and the second electronic circuitry.

In an embodiment, the pressure-tight element may be a ceramic element.

The pressure-tight element may alternatively be a glass element.

Alternatively, the pressure-tight element may include a metallic disc, and the transmission devices may include electrical conductors passed through bores in the metallic disc. Further, a glass, sapphire or a ceramic material may surround each conductor and fluidly seal the space between each conductor and the corresponding bore in the metallic disc.

In an embodiment, e.g. where the pressure-tight element is a ceramic element, the ceramic element may be so configured that it allows a current passage through the ceramic element. The ceramic element may in specific through-going lines or areas through the longitudinal direction thereof then be made of a mixture of a ceramic material and a conducting material (for example, platinum), so that current can be transferred across the ceramic element.

In this connection, it should also be understood that the ceramic element may be composed of several ceramic pieces along its longitudinal direction, which ceramic pieces, when assembled, will then form the ceramic element.

The current passage through the pressure-tight element may be obtained by using metallic or other electrically conducting materials. Wires or the like can then in a suitable manner be configured to be capable of being connected to each side of the pressure-tight element, so as to obtain a current passage through the pressure-tight element.

The sensor will be able to measure different parameters in the oil and/or gas well, after which these "measurements" in the form of suitable signals will be transmittable to the associated electronics. The associated electronics will then either be able to process the received signals themselves, or send these signals to another receiving and/or processing unit for further processing. This can be achieved in that the associated electronics can be connected to the receiving and/or processing unit via one or more electric wires, one or more signal cables etc., or even wirelessly.

The disclosed apparatus may be provided with one or more batteries or battery packs, which will supply the sensor, associated electronics etc. in the apparatus with necessary power as required. However, this can also be accomplished by connecting the apparatus to one or more power supplying wires.

To be able to connect the pressure-tight element, e.g. the ceramic element, in the apparatus, the pressure-tight element may be arranged in a sleeve, which sleeve is along a part of its length configured with a threaded portion. A corresponding threaded portion internally in the through bore in the apparatus will then be formed, so as to allow the sleeve containing the pressure-tight element to be connected to the apparatus.

In an embodiment of the present invention, the sensor is only designed to measure pressure and temperature, but it should be understood that the sensor may also be designed so as to be capable of measuring other parameters or additional parameters. It should also be appreciated that other devices may be used to carry out the desired measurements.

Furthermore, the sensor could be configured with a threaded portion along a part of its length, thereby enabling the sensor to be screwed to a tubular element, for example, a wellhead.

The flange assembly of the apparatus may be constituted of a front and a rear flange portion, where the rear flange portion overlaps a part of the front flange portion when they are assembled. The front and the rear flange portion will further be connected to each other by bolts, screws or the like, there additionally being provided one or more sealing devices, for example, O-rings or the like, between the overlapping parts of the front and rear flange portions, so as to provide a fluid-tight connection between them.

In order to be able to seal off one end of the apparatus when the apparatus is fixedly connected to a tubular element, for example, a wellhead, Christmas tree or the like, the end termination is configured with a projection, for example, in the form of a sleeve, at a distance from its outer periphery, which projection, when the end termination is connected to the rear flange portion, will extend a distance into the rear flange portion and essentially be in contact with the interior of the through bore in the rear flange portion. One or more sealing devices, for example, O-rings, are disposed between the overlapping portions of the end termination and the rear flange portion in order to provide a fluid-tight connection between them. The rear flange portion and the end termination are connected to each other by bolts, screws or the like.

It should be understood that the flange assembly may comprise more or fewer elements.

The flange assembly, the through bore therein and the end termination may have a circular shape, but it should also be understood that square, rectangular or other polygonal shapes may be used, both for the flange assembly and the through bore.

The apparatus may be arranged so as to be able to communicate with other similar apparatus. This may be done by connecting two or more apparatus together with the aid of at least one wire. The communication between the various units may also take place wirelessly.

The apparatus disclosed herein may be used in a temperature and pressure monitoring system for monitoring an oil and/or gas well.

Also disclosed is a wellhead for use with an oil and/or gas well, the well having a plurality of casings, the casings defining a plurality of annuli. The wellhead is configured with a plurality of through-holes, each leading into a respective annulus of the well. Each through-hole is connected to an apparatus as has been disclosed in the present specification.

Thus, by means of the present invention an apparatus is provided that can be used in connection with a temperature and pressure monitoring system which allows the sensors in the system to be mounted or demounted under pressure, i.e., that the oil and/or gas well may be in production whilst the mounting/demounting is carried out; the system will further preserve the barriers in the safety system and any pressure leaks in the oil and/or gas well will to far greater extent be prevented in that an indication of "abnormal" conditions in the well is given at an earlier stage.

Other advantages and special features of the present subject invention will be made clear in the following detailed description, the attached drawings and the following patent claims.

BRIEF DESCRIPTION OF THE DRAWINGS

The present invention will now be described with reference to several embodiments of the invention as shown in the figures, wherein.

DETAILED DESCRIPTION

Figure 1:
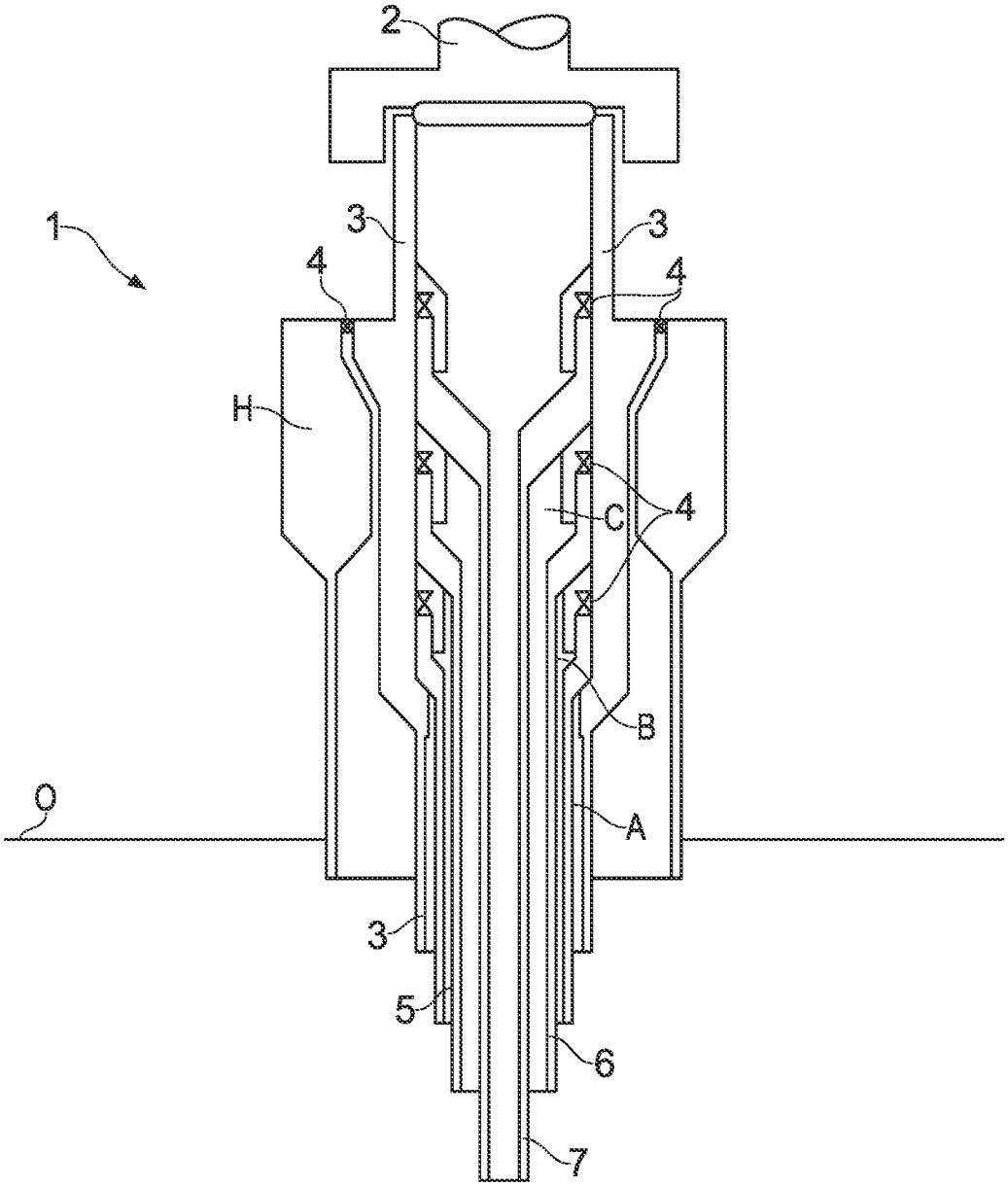
FIG. 1 is a schematic outline of a typical wellhead structure, comprising a temperature and pressure monitoring system.

FIG. 1 shows a typical wellhead structure that is used in connection with an oil and/or gas well, where a wellhead 1, at its upper end, is connected to a riser 2 which extends between a floating structure (not shown), for example, a platform or the like, and the wellhead 1. A first casing 3 extends a distance down into a surface formation and is cemented to the surface formation O.

The upper end of the first casing 3 is suitably suspended from the wellhead 1, sealing devices 4 in the form of one or more packers being arranged between an exterior surface of the first casing 3 and an interior surface of the pressurised housing H of the wellhead 1. Within the first casing 3 there is arranged another, second casing 5, which will then extend through the first casing 3 and a longer distance down into the surface formation O than the first casing 3.

The second casing 5 will, like the first casing 3, be cemented to the surface formation O. The second casing 5 will in addition be partly supported by (suspended in) the first casing 3. In order to obtain a tight connection between an interior surface of the first casing 3 and the exterior surface of the second casing 5, sealing devices 4 are provided between the first and the second casing 3, 5.

As the second casing 5 has a smaller diameter than the first casing 3, a space will be formed between the first and the second casing 3, 5, which space is called an annulus. The space that is delimited by the interior surface of the first casing 3, the second casing 5 and the casing hanger in the first and the second casing 3, 5 will define a first annulus A.

As described above for the first and the second casing 3, 5, a third casing 6 will run internally through the second casing 5, and will be supported by (suspended in) the second casing 5. The third casing 6 will have a diameter that is smaller than the diameter of the second casing 5. Here, the second and the third casing 5, 6, together with the casing hanger in the second and the third casing 5, 6, will define a second annulus B. Within the third casing 6 there is arranged a last and fourth casing 7, through which fourth casing 7 a production tubing (not shown) will run when the oil and/or gas well is in production. The fourth casing 7 will have a diameter that is smaller than the diameter of the third casing 6. The space that is formed between the third and the fourth casing 6, 7 and the casing hanger in the third and the fourth casing 6, 7 will form a third annulus C. To obtain a tight connection between an interior surface of the second and the third casing 5, 6 and the exterior surface of the third and the fourth casing 6, 7, sealing devices 4 are provided between the second and the third casing 5, 6 and the third and the fourth casing 6, 7.

The wellhead 1 may furthermore be connected to a blow-out valve (not shown), a so-called BOP (Blow Out Preventer).

The above wellhead structure will provide a fluid and pressure-tight system, but conditions in the oil and/or gas well might mean that the sealing devices 4, owing, for example, to large pressure build-ups in the well, temperature variations, or their service life, might begin to "leak", such that a pressure leak occurs in the well, where this is not desirable.

In order to prevent such undesired pressure leaks, a plurality of apparatus for measuring different parameters 8, which will be explained in more detail in connection with remaining FIGS. 2 to 4, will be arranged along the length of the wellhead 1, such that measurement and monitoring of different parameters, for example, pressure and/or temperature, can be carried out in each of the annuli A-C in the well. The wellhead 1 will then be configured with a plurality of through holes (not shown), to which holes the apparatus 8 can suitably be connected. The measurements made in each of the annuli A-C may be suitably transmitted to, for example, a floating structure for processing and monitoring.

Figure 2A:
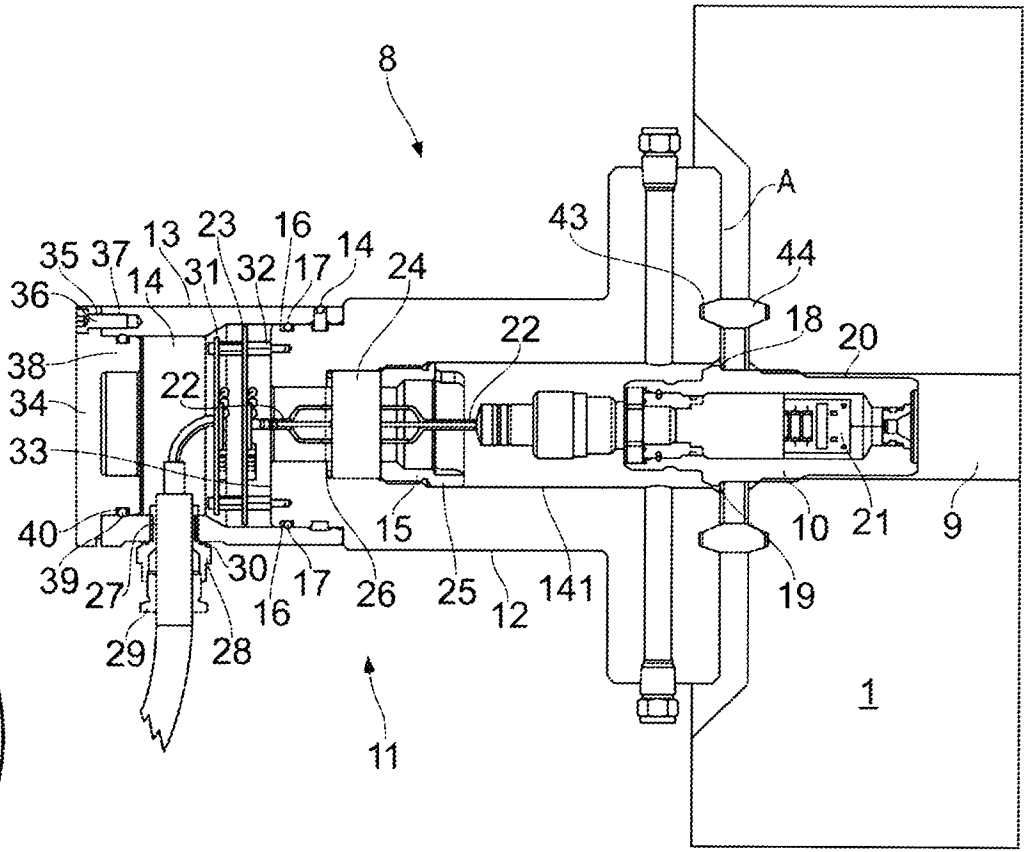
FIG. 2 shows a first embodiment of an apparatus according to the present invention, seen in a partial side view and in a cross-section.
Figure 2B:
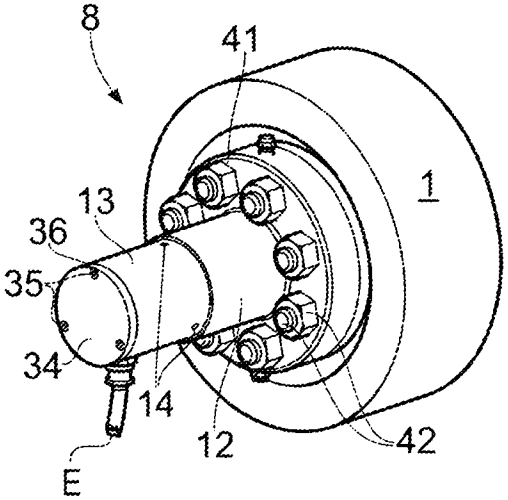

FIG. 2 shows a first embodiment of a measuring or monitoring apparatus 8 according to the present invention, where the apparatus 8 is shown partly from the side and in a cross-section, when connected to the wellhead 1. The wellhead 1 will then be configured with a plurality of through holes or passages, 9, which passages 9 will then be so positioned as to lead in to each of the annuli A-C. The apparatus 8 comprises a sensor 10 and a flange assembly 11, which are fixedly connected to each other. The flange assembly 11 is constituted of a front flange portion 12 and a rear flange portion 13, which via a plurality of bolts 14 or the like are connected to each other. An end of the rear flange portion 13 will then be so configured that it overlaps an end of the front flange portion 12 when the front and the rear flange portion 12, 13 are assembled. Both the front and the rear flange portion 12, 13 will furthermore be configured with a groove or recess 16, in which recess 16 an O-ring 17 is arranged when the front and the rear flange portion 12, 13 are connected to each other, so as to provide a fluid-tight connection between them.

The flange assembly 11 is further configured with a through bore 14, in which bore 14 the sensor 10 and the associated electronics 15 are arranged. A second end (opposite the end that is connected to the rear flange portion 13) of the front flange portion 12 will then be configured with a contact face 18 for the sensor 10, the said contact face 18 forming a stop edge for the sensor 10. The sensor 10 will then similarly be configured with a face 19 that will bear against the contact face 18 in the front flange portion 12, such that the sensor 10 is positioned correctly in relation to the wellhead 1. The sensor 10 will furthermore, along a part of its length, be configured with a threaded portion 20, such that the sensor 10 can be screwed into the passage 9 in the wellhead 1. The passage 9 in the wellhead 1 will then be configured with a complementarily threaded portion (not shown).

The sensor 10 comprises a first electronic circuitry, e.g. in the form of an electronic printed circuit board 21, which via wires 22 is connected to a second electronic circuitry in the form of a separate main printed circuit board 23 arranged in the bore 14 in the front flange portion 12. Through this configuration, the sensor 10, comprising the electronic printed circuit board 21, will be separated from the main printed circuit board 23, the sensor 10 being arranged at the end of the front flange portion 12 which lies closest to the wellhead 1, whilst the separate main printed circuit board 23 will be arranged at an opposite end of the front flange portion 12, adjacent to the rear flange portion 13.

Between the sensor 10 and the separate main printed circuit board 23 there is disposed a pressure-tight element 24, for instance a ceramic element with wires 22 connecting the sensor 10 and the separate main printed circuit board 23 extending through the ceramic element.

In one embodiment, the wires 22 will, however, not run through the whole of the ceramic element 24, only a certain length into the ceramic element 24, such that wires 22 from sensor 10 and wires 22 to the main printed circuit board 23, when arranged in the ceramic element 24, will be located at a distance from each other. The ceramic element 24 is however so configured that through at least one through-going portion or area through the ceramic element 24 there is arranged a mixture of a ceramic material and an electrically conducting material (for example, platinum). This will mean that the ceramic element 24 will form a pressure-tight barrier in the apparatus 8. The ceramic element 24 is in a fluid and/or pressure-tight way connected to a sleeve 25. The sleeve 25 is further configured with a threaded portion (not shown) and a varying cross-section along its length. The current passage through the ceramic element 24 may however be achieved by, for example, using metallic or other electrically conducting materials.

The pressure-tight element 24 has been described above, by example, as a ceramic element. In this case the pressure-tight element 24 may be provided as a ceramic feedthrough disc, wherein wires or other electrical conductors may be embedded in the ceramic element. The ceramic material may be chrystalline or non-chrystalline. The ceramic material may, e.g., include aluminium oxide.

Alternatively, the pressure-tight element 24 may be a glass element, or as another alternative, the pressure-tight element 24 may include a metallic disc (e.g., made of steel or titanium), and the transmission devices may be electrical conductors (e.g., made of platinum) passed through bores in the metallic disc. Further, a glass, sapphire or a ceramic material may surround each conductor and fluidly seal the space between each conductor and the corresponding bore in the metallic disc.

The pressure-tight element 24 may be located in a portion of the bore 14 where the diameter is reduced. The pressure-tight element 24 is shown fitted into a portion of the bore having a diameter corresponding to the diameter of the pressure-tight element 24. A sleeve 25 is located in the bore 14 in engagement with a first side of the pressure-tight element facing the passage 9. The sleeve 25 in this position exerts pressure to the isolation element 24. The sleeve may be configured with threads, provided for engagement with threads in the bore 14, and may be provided with a diameter enlarged portion 25*b* arranged to fit with a restriction of the bore 14 which may provide an end stop for the sleeve 25. By engaging the threads of the sleeve 25 with the threads of the bore 14, the sleeve may be screwed into a position exerting a pressure to the pressure-tight element 24. A second side of the isolation element 24, which faces away from the passage 9, rests against a restriction in the diameter of the bore providing a contact portion 26. In between the contact portion 26 and a portion of the second side of the isolation element a seal, for instance a metallic seal, may be provided. By moving the sleeve 25 relative to the bore 14, for instance by screwing the sleeve 25 relatively to the bore 14 the isolation element 24 exerts a force to the seal of a size which provides an isolation engagement between the contact portion 26, the seal and the isolation element 24. This arrangement may enable or further improve the pressure tight properties of the apparatus.

The through bore 14 in the front flange portion 12 will along a part of its length be configured with a varying cross-section, which varying cross-section will be complementarily configured with the varying cross-section of the sleeve 25. A rear edge 26 of the varying cross-section in the through bore 14 will, when the sleeve 25 with the pressure-tight element 24, e.g. ceramic element, is arranged in the varying cross-section of the through bore 14, together with an end of the sleeve 25, form a tight connection between the front flange portion 12 and the sleeve 25. This arrangement may form a fireproof connection in the apparatus 8.

The rear flange portion 13 is configured with a through and threaded hole 27, so as to enable a cable lead-in 28, comprising a tensioning nut 29, to be connected to the threaded hole 27. Between the contact faces of the rear flange portion 13 and the cable lead-in 28 there is arranged a seal 30 in the form of an O-ring. An electric cable E is then passed through the cable lead-in 28 and connected to a connecting printed circuit board 31 in the though bore 14 in the flange assembly 11.

The separate main printed circuit board 23 and connecting printed circuit board 31 are, by means of a securing device 32, connected to a rear wall 33 of the front flange portion 12. The securing device 32 will further ensure that the main printed circuit board 23 and the connecting printed circuit board 31 are arranged at a distance from each other. Signals received from the sensor 10 will then be wirelessly transmittable from the main printed circuit board 23 to the connecting printed circuit board 31, in order thus, through the electric wire E, to be transmitted for processing on a floating structure (not shown).

The rear flange portion 13, which is an "open" sleeve, is, at an end opposite the end overlappingly connected to the front flange portion 12, configured for being connected to an end termination 34, such that the apparatus 8 can be closed or sealed at the end opposite the connection to the wellhead 1. The end termination 34 is then configured with a plurality of through openings 35, which through openings 35 are used for passage of bolts 36. An end termination in the rear flange portion 13 will then be configured with a plurality of threaded holes 37 for receipt and screw fastening of bolts 36.

The end termination 34 will on one side be configured with a projection 38, which projection 38 will be such that it essentially corresponds to the through bore 14, such that the projection 38 will extend a certain distance into the rear flange portion 13 when the end termination 34, via the bolts 36, is connected to the rear flange portion 13. A seal 39 in the form of an O-ring is arranged between the interior surface of the rear flange portion 13 and the exterior surface of the projection 38, one or both of these surfaces then being configured with a groove for receiving the seal 39.

Furthermore, the front flange portion 12, in a face A which forms contact with the wellhead 1, is configured with a plurality of holes 41, such that bolts and nuts 42 can be used to fixedly connect the apparatus 8 to the wellhead 1. Face A is further configured with a recess 43 for receiving a sealing element 44 such that a tight connection is provided between the apparatus 8 and the wellhead 1 when they are connected to each other.

Figure 3:
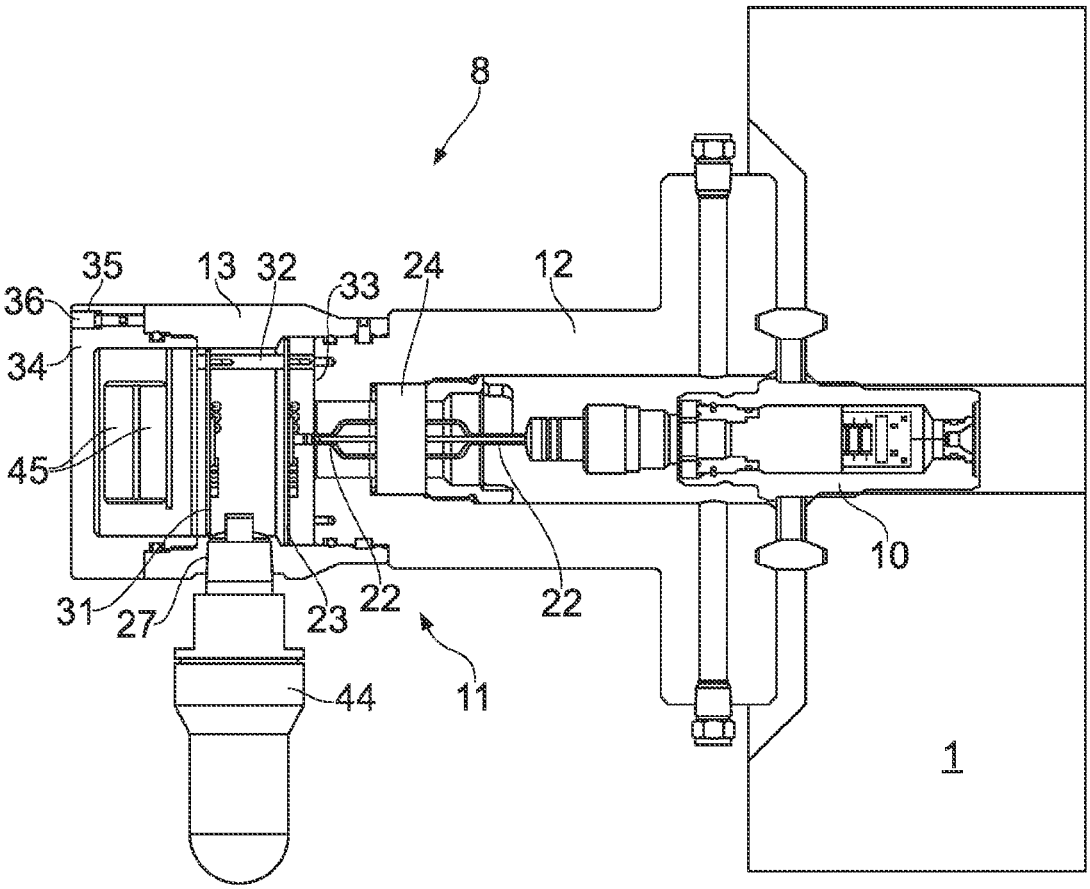
FIG. 3 shows a second embodiment of the apparatus according to the present invention, seen in a cross-section.

FIG. 3 shows another embodiment of the apparatus 8 according to the present invention, where the apparatus 8 is now configured so as to be able to transmit signals from the sensor 10 wirelessly. With the exception of how the transmission of signals takes place according to this embodiment, the general component composition of the apparatus 8 and its operating principle are the same as described for the first embodiment of the invention as shown in FIG. 2, and so for the sake of simplicity they are not described again.

The embodiment shown in FIG. 3 uses a wireless transmission of signals from the sensor 10, where the rear flange portion 13 will be configured with a through and threaded hole 27, so as to enable a wireless antenna 44 to be connected to the through and threaded hole 27. A securing device 32 is also used in this embodiment to connect the separate main printed circuit board 23 and the connecting printed circuit board 31 to the rear wall 33 of the front flange portion 12. However, the distance between the main printed circuit board 23 and the connecting printed circuit board 31 will now be greater than in the embodiment described with reference to FIG. 2, seen in relation to the fact that a part of the wireless antenna 44 will extend a distance into the through bore 14 in the flange assembly 11. Signals received from the sensor 10 will then be wirelessly transmittable from the main printed circuit board 23 to the connecting printed circuit board 31, so as to be further transmittable wirelessly from the connecting printed circuit board 31 to the wireless antenna 44, in order to be further transmitted wirelessly for processing on a floating structure (not shown). For signal amplification, a plurality of signal amplifying units (not shown) may be provided between the wellhead and the floating structure.

To operate the sensor 10 and/or the wireless antenna 44 in the apparatus 8, a battery or a battery pack 45 is provided in the apparatus 8 when the apparatus 8 is assembled. This embodiment will mean that the battery or battery pack 45 can easily be replaced by unscrewing bolts 36 in the end termination 34 and removing the end termination 34 from the rear flange portion 13. The battery or battery pack 45 can in a suitable manner, for example, by means of wires etc. (not shown), be connected to the connecting printed circuit board 31.

The battery or battery pack 45 may also be connected to, or comprise a device (not shown) capable of ensuring that the battery or battery pack 45 is turned off and on at certain time intervals. The device can then turn the battery or battery pack 45 on for a pre-specified time unit (minutes, hours or days), so as to allow the desired number of measurements of, for example, pressure and temperature to be carried out, after which the device will turn the battery or battery pack 45 off. However, it should be understood that such a device must also comprise the possibility of being overridden, seen in relation to the fact that measurements with the apparatus 8 may also be carried out outside the pre-specified time units.

Figure 4A:
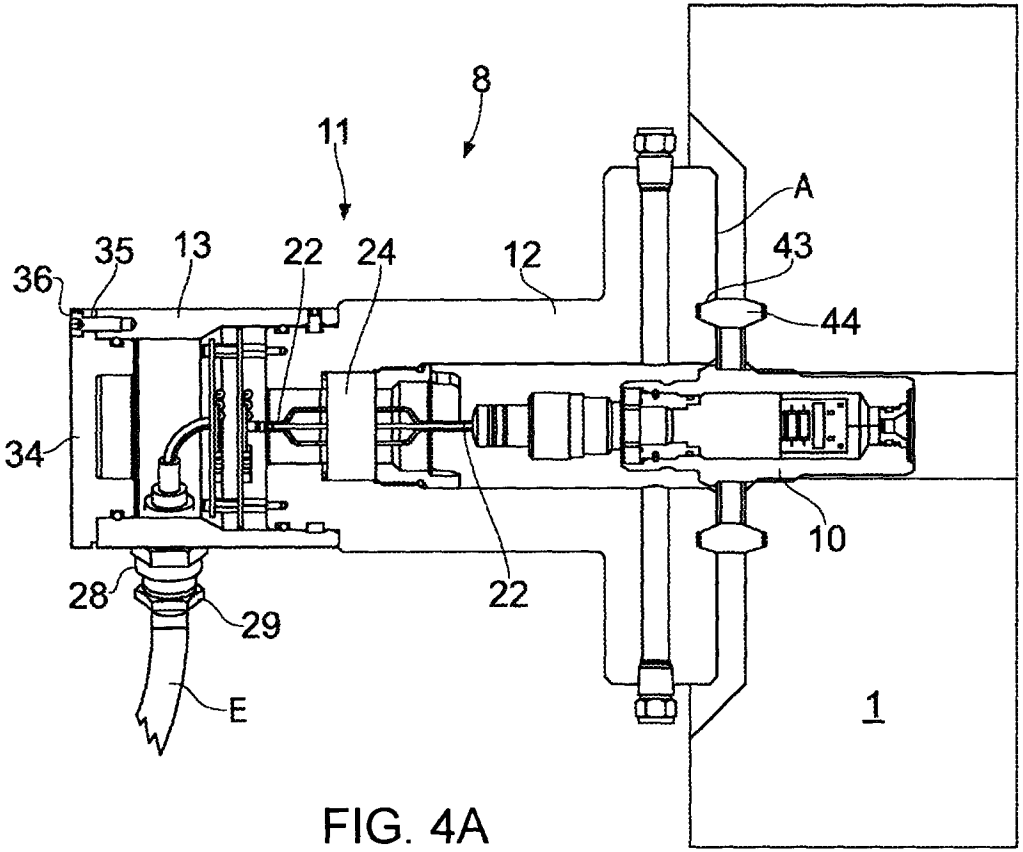
FIG. 4 shows a third embodiment of the apparatus according to the present invention seen from the rear and in a cross-section.
Figure 4B:
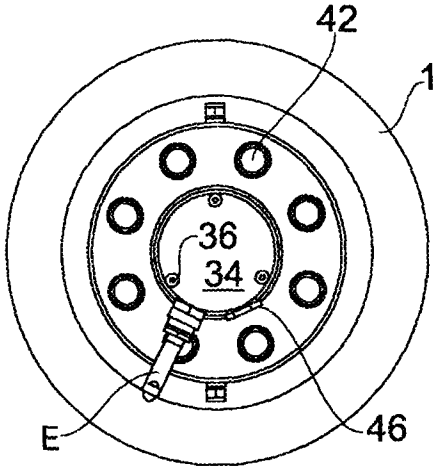
Figure 4C:
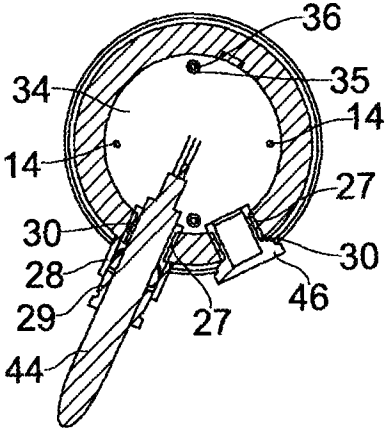

FIG. 4 shows an additional embodiment of the apparatus 8 according to the present invention, where the rear flange portion 13 in the apparatus 8 is configured with several through and threaded holes 27. The general component composition of the apparatus 8 and its operating principle are the same as described for the first embodiment of the invention as shown in FIG. 2, and so for the sake of simplicity they are not described again.

Configuring the rear flange portion 13 with several through and threaded holes 27, will enable the apparatus 8 to be connected to two electric cables E, an electric cable E and a wireless antenna 44, or even two wireless antennas 44. Alternatively, one of the through and threaded holes 27 can initially be closed by a stop plug 46. If, for example, the electric wire E or the wireless antenna 44 for some reason is knocked off or damaged there will be the possibility of connecting to the apparatus 8 by removing the stop plug 46 and, for example, coupling a wireless antenna 44 to the other through and threaded hole 27.

In addition, this embodiment will also permit several similar apparatus to be connected on the same line, where the apparatus will then be able to communicate with each other digitally.

The invention has now been explained by referring to some non-limiting examples. A person of skill in the art will understand that it will be possible to make a number of variations and modifications to the temperature and pressure monitoring system as described within the scope of the invention as defined in the attached claims.

The invention claimed is:

1. An apparatus for monitoring physical parameters in an oil and/or gas well, the apparatus being connected to a wellhead of the oil and/or gas well, the apparatus comprising a flange assembly configured with a through bore and end termination, in which through bore a sensor and associated electronics are arranged, wherein the sensor, including a first electronic circuitry, is connected to a second electronic circuitry via transmission devices that are passed through a pressure-tight element arranged in the through bore, wherein the pressure-tight element includes a metallic disc, the transmission device being electrical conductors passed through bores in the metallic disc, and wherein a glass, sapphire or a ceramic material surrounds each conductor and fluidly seals the space between each conductor and the corresponding bore in the metallic disc.

2. An apparatus according to claim 1, wherein the sensor includes a temperature transducer.

3. An apparatus according to claim 1, wherein the sensor includes a pressure transducer.

4. An apparatus according to claim 1, wherein the sensor includes a pressure and temperature transducer.

5. An apparatus according to claim 1, wherein the first electronic circuitry includes a first electronic printed circuit board, the second electronic circuitry includes a second printed circuit board, and wherein the transmission devices include wires connected between the first electronic printed circuit board and the second printed circuit board.

6. An apparatus according to claim 5, the flange assembly having a front flange portion 12 and a rear flange portion 13, wherein the sensor, including the first printed circuit board, is arranged at an end of the front flange portion which lies closest to the wellhead.

7. An apparatus according to claim 6, wherein the second printed circuit board is arranged at an opposite end of the front flange portion, adjacent to the rear flange portion.

8. A wellhead for use with an oil and/or gas well, the well having a plurality of casings, the casings defining a plurality of annuli, the wellhead being configured with a plurality of through-holes, each leading into a respective annulus of the well, wherein each through-hole is connected to an apparatus as set forth in claim 1.

* * * * *